United States Patent [19]

Hopkins

[11] Patent Number: 4,765,773

[45] Date of Patent: Aug. 23, 1988

[54] MICROWAVE HIGHWAY PAINT DRYING APPARATUS

[76] Inventor: Harry C. Hopkins, Rte. 5, Box 883, Williamston, N.C. 27892

[21] Appl. No.: 20,109

[22] Filed: Feb. 27, 1987

[51] Int. Cl.[4] ..... E01C 23/16; E01C 23/14

[52] U.S. Cl. ..... 404/94; 404/95; 404/126; 239/135; 34/1; 118/305; 118/620; 427/45.1; 427/137; 427/421

[58] Field of Search ..... 404/77, 79, 93–95, 404/126; 239/135; 34/1; 118/305, 620; 427/45.1, 137, 421

[56] References Cited

U.S. PATENT DOCUMENTS

| | | | |
|---|---|---|---|
| 3,018,704 | 1/1962 | Searight | 404/94 |
| 3,046,854 | 7/1962 | Wilson | 404/94 |
| 3,279,336 | 10/1966 | Eaton et al. | 404/94 |
| 3,472,200 | 10/1969 | Gerling | 118/305 X |
| 4,175,885 | 11/1979 | Jeppson | 404/77 |
| 4,252,487 | 2/1981 | Jeppson | 404/79 X |
| 4,319,856 | 3/1982 | Jeppson | 404/79 |

*Primary Examiner*—George A. Suchfield
*Assistant Examiner*—John F. Letchford
*Attorney, Agent, or Firm*—Darby & Darby

[57] ABSTRACT

A mobile paint application and microwave drying apparatus has a downwardly open hollow frame forming a microwave cavity movable over a surface on rollers. The interior cavity of the frame is coated with microwave absorbent material, as are the rollers. The frame in the front and rear conforms to the rollers with a certain gap and ends above the surface at a certain distance. Treads extend between the front and rear rollers on each side and have a thickness which is greater than the gap and distance so as to create a circuitous path from the cavity which blocks microwave radiation. A paint spray nozzle is located in the cavity and applies paint to the surface. This paint is rapidly dried by a microwave generator which is positioned in the cavity and directs radiation onto the wet paint.

14 Claims, 2 Drawing Sheets

MICROWAVE HIGHWAY PAINT DRYING APPARATUS

TECHNICAL FIELD

This invention relates to the use of microwaves to dry liquids as they are applied to surfaces and, more particularly, to the continuous drying of paint as it is applied to highways or other surfaces. Background Art It is well known to use microwave radiation to cook or merely dry products which have excess moisture. For example, it is known to use microwave radiation to dry recently harvested crops. An example of such a use of microwaves is illustrated in U.S. Pat. No. 4,430,806, which issued to the present inventor.

The difficulty with any microwave equipment is that the radiation can be harmful to animals, including humans. Thus, techniques are required which allow the radiation to be directed where it is needed without reaching nearby animals or people, especially the people required to operate the equipment. When a small quantity of stationary product is to be dried, it can be positioned in a closed container, e.g. a microwave oven, and safely exposed to the radiation. However, the problem is much more difficult when the product must be moved through the microwave drying apparatus. In particular, the apparatus must be open to allow product to move into and out of the apparatus, but microwave radiation must be prevented from escaping. This problem is solved according to U.S. Pat. No. 4,430,806, with respect to harvested grain moving on a conveyor belt, by introducing the grain and removing the grain from the microwave chamber through labyrinth seals.

The roads and highways of the country must be painted frequently with markings indicating dividing lines, turn lanes, cross walks and other safety signs. While these markings are usually applied in the form of fast drying paint, the paint does not dry instantly. Thus a portion of the road or highway must be blocked off for a time sufficient to allow the paint to dry. This, however, can lead to traffic congestion. If the road is not blocked for a sufficient time to allow the paint to dry, vehicle traffic can smear the paint making it unsightly. Also in some instances the traffic will mar the marking to such an extent that the safety message is unclear, which could lead to accidents.

Various methods for accelerating the drying of highway paint are known from the prior art. For example, U.S. Pat. No. 3,018,704 of Searight teaches the use of a flame heater to preheat the pavement prior to application of the paint. After the paint is applied, a radiant heater is used to dry it.

U.S. Pat. No. 3,472,200 of Gerling discloses a combination of infrared and microwave heaters mounted to a mobile highway painting apparatus for rapidly drying the paint. In the Gerlings patent apparatus, the leakage of microwaves is prevented through the use of tiltable microwave cavities, slow-wave waveguide structures, and shields which are especially arranged to trap microwaves.

Besides drying highway patent, it is also known to use drying apparatus to dry paint applied to other surfaces. U.S. Pat. No. 3,709,194 discloses infrared apparatus for drying protective coatings applied to the hull of a ship. Such an application of drying apparatus is of particular utility in the painting of rooms which cannot be conveniently kept out of service for extended periods, e.g., hospital emergency rooms, dentist,s offices, etc.

DISCLOSURE OF THE INVENTION

The present invention is directed to the microwave drying of paint as it is applied to a surface, while confining the microwaves safely within the paint application structure. This object is achieved in a simple manner by a combination of sliding and rolling microwave shields.

In an illustrative embodiment of the invention microwave drying equipment is added to a mobile highway paint striping trailer towed by a truck. The microwave equipment is in the form of a four wheel vehicle with a relatively flat upper surface. This surface is made of, or its underside is lined with, a microwave absorbent material.

Also extending down from the upper surface along its sides are fixed microwave absorbent shields. These are arranged so they are in sealing engagement with the upper surface and extend to the vicinity of the highway. Similar shields may also extend from the front and back edges of the upper surface so as to form a generally enclosed cavity below the upper surface. Also, flexible shields of microwave absorbent material may extend from the upper surface into light contact with the road surface. Further, the wheels of the vehicle can be made in the form of rollers which are covered with microwave absorbent material to create rolling seals that increase the microwave sealing capacity of the cavity.

A conventional paint stripe spray nozzle is suspended from the underside of the upper surface of the vehicle into the cavity just behind the front wheels. This nozzle applies the highway paint stripe to the pavement. Also, located within the cavity are one or more microwave generators arranged to direct microwave radiation onto the paint stripe formed by the spray nozzle so as to dry it.

In the embodiment designed for applying a straight paint stripe, the front wheels are surrounded by a unitary roll of microwave absorbent material that extends completely across the front of the trailer to form a rolling seal and the rear wheels may also be provided with such a rolling seal. In addition two treads of microwave absorbent material extend from a front wheel to a rear wheel on each side of the paint spray nozzle. The treads allow small bumps in the roadway to be covered such that no microwaves leak out when they are passed over.

In another embodiment for applying a curved paint stripe, the two front and two rear rollers are separately rotatable with respect to each to allow them to travel at different speeds to affect a turn. However, the adjacent edges of the rolls have a tongue and groove arrangement to provide a seal.

The combination of fixed microwave shields, backed up by rolling microwave seals and flexible shields, keeps the microwaves from escaping and harming personnel working on the paint stripe equipment or passing motorists. While the sealing of the microwave cavity is not, and cannot be complete, i.e. with no openings, the openings are so staggered with respect to each other that microwaves, which travel in straight lines, cannot escape.

The principles of the present invention can also be utilized to create a wall paint drying apparatus which is useful in situations where rapid paint drying is important, e.g. in facilities, such as hospital emergency rooms, that cannot be taken out of service for long periods of time. This same device can be provided with an exhaust system which allows fumes created by the drying process to be removed from the room. Such a system is useful when the device is utilized in a closed environment which may have to be occupied by ill people shortly after the painting has been completed.

BRIEF DESCRIPTION OF THE DRAWINGS

The foregoing and other features of the present invention will be more readily apparent from the following detailed description and drawings of illustrative embodiments of the invention in which.

DESCRIPTION OF ILLUSTRATIVE EMBODIMENTS

Figure 1:
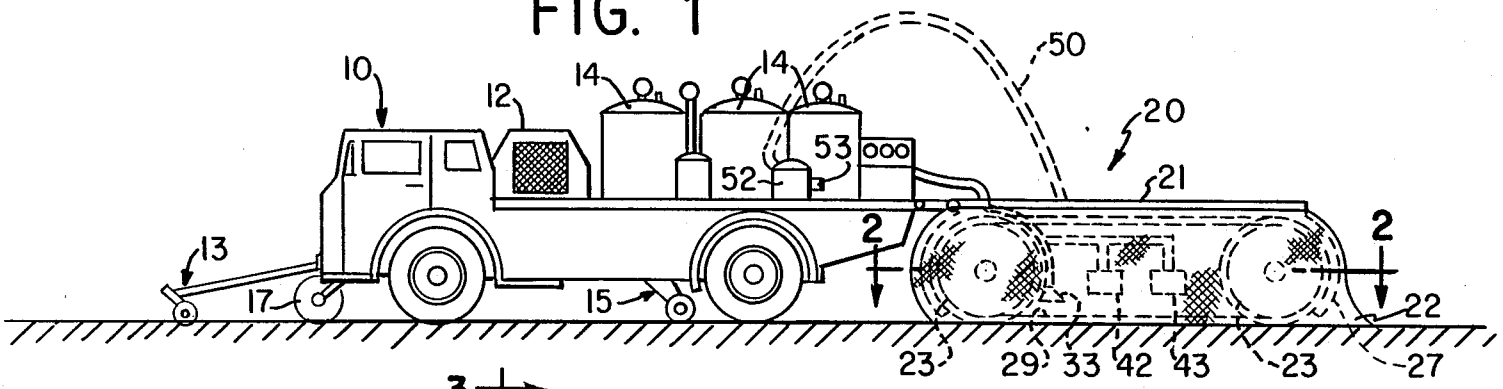
FIG. 1 is a side view of a highway paint stripe application vehicle according to the present invention.

FIG. 1 illustrates a side view of highway traffic marking equipment according to the present invention. As pictured in FIG. 1, the equipment has two major components: a traffic marking vehicle 10 and a microwave paint stripe application and microwave drying apparatus 20 which is towed by the vehicle 10. The vehicle 10 may be of conventional design, such as the equipment sold by Prismo Universal Corporation of Huntington, Pennsylvania under the trademark WALD.

Basically the vehicle 10 is a truck which has a generator 12, paint supply tanks 14 and a control panel 16 mounted on its rear. These vehicles, as conventionally equipped, include spray nozzles which apply highway paint stripes. In some versions the stripe is applied ahead of the vehicle by a nozzle attached to a boom assembly 13. Such a nozzle is guided to the proper location by a wheel located at the end of boom 13. Additionally the paint spray nozzle may be located under the body of the truck and associated with another roller boom 15. However, according to the present invention, the paint is applied from the rear of the vehicle and within the interior of equipment 20. In order to make sure that the highway is clear of debris at locations where the paint stripe is to be applied, a rotating brush 17 is attached to the forward part of the truck body.

An external view of paint application and drying apparatus 20 will show only a flexible microwave absorbing shield 22, which extends in all four directions from upper platform 21 of the device 20. This flexible shield 22 extends into contact with the pavement. The flexible shield may be made of a heavy fabric, e.g. canvas, coated with a microwave absorbent material. The canvas may have a particular shape defined by heavy metal wire 19 (FIG. 2) located in contact with shield 22. In applying a highway paint stripe, the vehicle moves at a relatively slow speed, for example 10 miles per hour. Thus there is relatively little wearing of the flexible shield 22 during a paint application process. This assures that it is difficult for microwaves used to dry the paint to escape easily.

Figure 2:
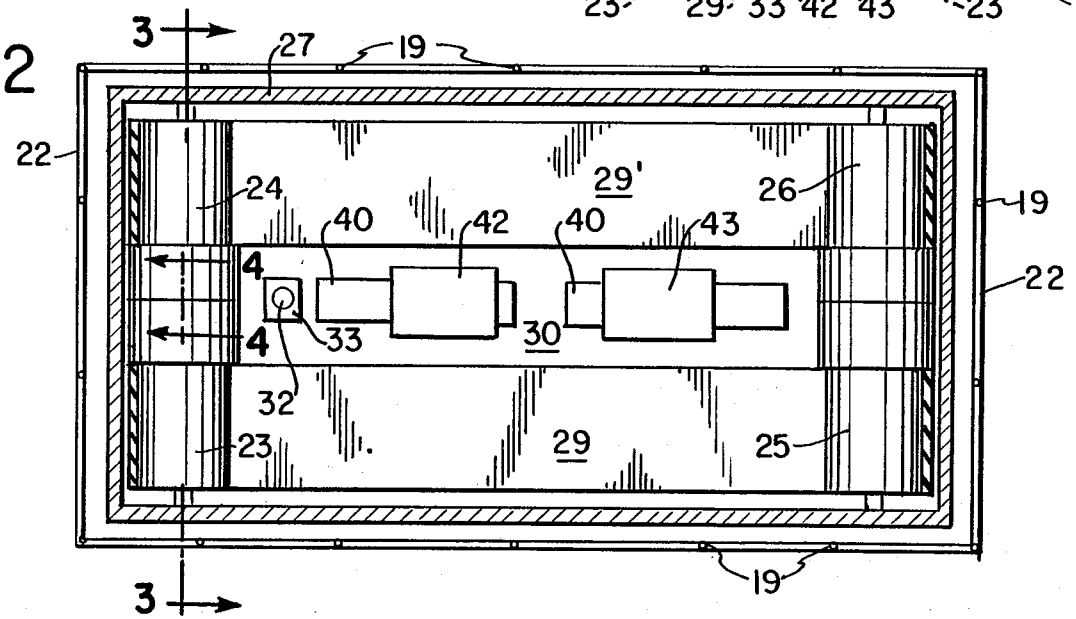
FIG 2 is a top sectional view of the microwave dryer portion of the vehicle of FIG. 1 along line II—II.
Figure 3:
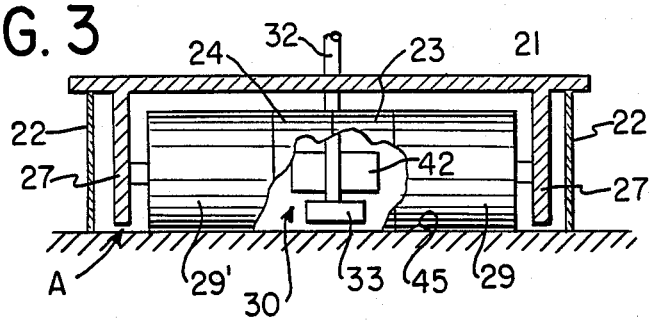
FIG. 3 is a side sectional view of the microwave dryer portion of the vehicle of FIG. 2 along line III—III.

Within the apparatus 20 there are four wheels, two front 23, 24 and two rear 25, 26. The wheels, as best seen in FIG. 2, are actually in the form of large rollers. These rollers may be made of microwave absorbing material or maybe coated with such material. As a result these wheels form additional microwave barriers within the cavity formed by the flexible shield 22. The wheels are supported by a rigid frame 27 which extends completely about the cavity 30 and is attached to upper surface 21. FIG. 3 shows that this frame 27 extends to the vicinity of the highway, but does not touch it, as does the flexible shield 22. The interior portions of frame 27 are also covered with microwave absorbing material. Toward the outer edges of the wheels 23–26 there are recesses in which flexible treads 29 are received. FIG. 1 shows that one tread extends from wheel 23 in the front to wheel 25 in the rear. Similarly, a tread 29' extends from roller 24 in the front to roller 26 in the rear. These treads 29, 29' have a thickness which is equivalent to or greater than the gap between the bottom edge of frame 27 and the highway. Thus the rigid frame 27 and the treads 29, 29' form a primary seal to backup the flexible seal created by shield 22.

The rigid shield 27 at the front and rear surfaces of apparatus 20 follow the curve of the front and rear rollers as shown in FIG. 1. This allows the frame 27 to better cooperate with treads 29 in sealing microwaves within the interior of vehicle 20.

When it is desired to apply a paint stripe to the highway, one operator drives the vehicle along the highway at the proper speed and position. The boom 13 may be used by the operator to guide the proper positioning of the vehicle 10. A second operator, sitting at controls 16, starts the generator 12 to power the paint application process. By operating the controls 16, paint is delivered from tanks 14 at high pressure through a conduit 32 which enters apparatus 20. Conduit 32 passes behind the front rollers to a spray nozzle 33 located just above the highway surface. Paint is then sprayed onto the highway in a conventional manner so as to form paint stripes 40 as shown in FIG. 2. In order to rapidly dry this paint, two microwave generators 42, 43 are located after the spray nozzle 33 in positions to direct microwave energy onto the paint stripes. These microwave generators are of conventional design and may be of the type disclosed in U.S. Pat. No. 3,472,200 of Gerling, the disclosure of which is incorporated herein by reference.

The rollers 23–26, the tread 29 and the rigid frame 27 all act together to form an interior microwave sealed chamber or cavity 30. In addition, a backup seal is formed by the flexible shield 22. As a result, the microwave generators 42, 43 may be operated within the cavity 30 without causing significant microwave leakage which would harm the operator sitting at control 16 or would harm motorists in passing vehicles. Reference to FIG. 3 shows that microwaves within the cavity 30 are blocked from vertical escape by the upper surface 21 of the apparatus. This surface is made of or covered by microwave absorbing materials. Laterally directed microwaves are blocked in part by the rollers, and the side walls and end walls of frame 27. Since this frame does not touch the ground, as shown at A in FIG. 3, there is a possible path for the escape of radiation. However, this path is blocked by the tread 29, such that microwaves would have to travel a very circuitous path over the tread 29 and then down between the tread and wall 27. Since microwaves travel in straight lines, it is unlikely that the microwaves could affect escape by that route. Nevertheless, even if stray microwaves did travel that path, they would be blocked by flexible shield 22.

Tread 29 also has an additional benefit because it is made of relatively thick and flexible microwave absorbing materials or a material which is coated with microwave absorbent material. Small bumps or debris 45 in the road (FIG. 3) will not break the seal. Rather, the tread will compress over the stone or bump without causing the edges of the tread to rise up from the pavement. Thus, the seal is maintained.

In situations where only a straight stripe is being laid down, rollers 23 and 24, as well as rollers 25 and 26, can be one piece, respectively. This means that the rollers form significant shields to the escape of microwaves along both the front and rear edges of the apparatus 20. Since the operating personnel sit in the vicinity of control 16, they're provided with additional protection. Further, passing motorists are not likely to be in the vicinity of the microwaves for any great period of time, so the danger to them from the escape of microwaves is very low. However, a vehicle traveling behind the equipment might stay in that position for a considerable period of time. In recognition of this, the rollers 25, 26 at the rear of the apparatus provide additional protection to the escape of microwaves in that direction. Further, it should be noted that the microwave generators direct their radiation principally towards the paint stripes to be dried and it is generally only the reflective radiation that is susceptible to escape. Thus, varying the orientation of the microwave generators acts to reduce the likelihood of the escape of radiation from the apparatus.

Figure 4:
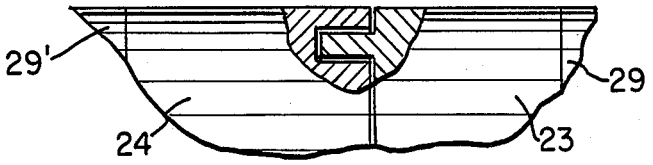
FIG 4 is an enlarged partial sectional view of the intersection of the rollers of FIG. 2 along line IV—IV.

It is frequently necessary to lay down highway stripes on curves. This would be difficult to do if the front and rear rollers were unitary. Thus, as shown in FIG. 2, the rollers can be separate, such that they may turn at different speeds to follow a curved path. However, when this is the case the abutting rollers 23, 24 and 25, 26 are given a tongue-and-groove construction as shown in FIG. 4 in order to reduce the likelihood that microwave radiation will leak from between the two rollers. In a situation where significant curved motion is required by the apparatus 20, the roller 23–26 can be made to pivot about a horizontal axis. However, in such a case there is likely to be a gap between the rollers to permit this rotation. Thus, there will be some sacrifice in the front and rear microwave sealing affect in order to reduce the turning radius of the apparatus.

The length of the apparatus, as pictured in FIG. 2, is about ten feet. If the vehicle is travelling in the range of 5 to 15 miles per hour, it is possible for the microwave generators to sufficiently dry the paint by the time it reaches rear rollers 25, 26. Consequently the rollers do not mar or smear the paint. In winter weather conditions this drying affect can be improved by including preheating equipment of conventional radiant heater type in order to warm the highway prior to the application of the paint stripe.

The controls for the microwave generator can be included in the main conventional control panel 16 for the equipment. Such controls are capable of turning the paint application on and off to create an interrupted stripe along the highway and, if necessary or advisable, the microwave generators can be turned on and off in sequence with this paint application in order to both conserve energy and reduce the risk from radiation. Further, the power output of the microwave generators can be controlled in response to the vehicle speed such that the power output is increased with increasing speed.

In some cases, ice or snow on the roadway cannot be removed by the brush 17 and the application of heat by a radiant heater. In such a situation the paint application can be turned off and the whole unit moved along the path to be coated with paint. The microwave generators would then assist in melting any ice located on the pavement such that during a second pass the highway marking stripe could be effectively applied.

Another alternative use for the present apparatus is for the removal of old highway paint. In such a situation, the apparatus would be moved over the old paint and the microwave generators would be set at such a high level as to evaporate or volatilize the old paint. If necessary, the exhaust system carried on the vehicle 10 could be used to suck the volatilized paint fumes from within the cavity, pass them through a filter 52 and discharge them into the atmosphere at exhaust 53. Such a suction line is shown in dotted line in FIG. 1 as exhaust conduit 50.

Figure 5:
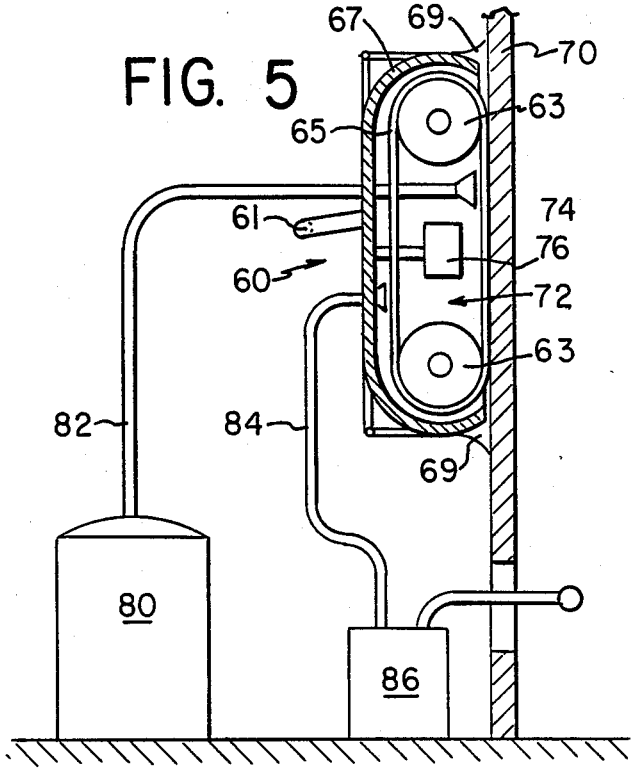
FIG 5 is a sectional view of a miniaturized version of the apparatus of FIG. 1 used to paint and quickly dry walls.

A miniaturized version 60 of the apparatus 20 shown in FIG. 1, is illustrated in FIG. 5. This unit is useful for spray painting walls which must be dried quickly. The unit 60 has a handle 61 which may be utilized to manually move the device along a wall or to attach the unit to some sort of support device for moving the unit along the wall with mechanical assistance. The unit includes wheels 63 which are surrounded by treads 65. Located exterior to the wheels and the treads is a fixed frame 67 which does not come in contact with the wall 70, but which in combination with the treads forms an interior rolling microwave seal. A flexible microwave shield supported by metal wire is positioned outside the frame and does extend into contact with wall 70. This flexible shield 69 provides backup for the interior shield and assures that microwaves do not leak.

The shield structures result in a cavity 72 in which a paint spray nozzle 74 and a microwave generator 76 are located. The paint spray nozzle 74 applies a paint coating to the wall 70 as the unit is moved upward as shown in FIG. 5. This upward motion then brings the microwave generator 76 over the area which has just been painted so as to rapidly dry it before the rear sealing roller 63 reaches the area. A supply of paint 80 which is under pressure, is connected to nozzle 74 through a flexible conduit 82. In addition, the interior cavity is connected by a conduit 84 to a vacuum unit 86. This vacuum unit sucks out any noxious vapors from the cavity 72 and directs them outside the room being painted.

With this arrangement, a room, for example, a hospital emergency room, can be rapidly painted and the paint dried without the creation of noxious fumes. Thus the room can be reoccupied even by those suffering respiratory illnesses in a relatively short period of time.

While the invention has been particularly shown and described with reference to preferred embodiments thereof, it would be understood by those skilled in the art that various changes in form and details may be made therein without departing from the spirit and scope of the invention.

I claim:

1. A mobile microwave drying apparatus comprising a generally hollow box shaped frame having a upper wall, two side walls, a front wall and a rear wall, but which is open on the bottom, the interior surfaces of the frame being covered with a microwave absorbent material and forming a microwave cavity, front and rear rollers pivotally attached to the side walls of said frame adjacent the front wall and rear wall, respectively, such that said frame is mobile over a surface contacted by said rollers, the frame being spaced from the surface by a certain distance;

at least one tread extending about said front and rear rollers, said tread being covered with microwave absorbent material, the thickness of said thread being greater than the certain distance so as to substantially eliminate any straight path from the microwave cavity to the exterior of the frame, except through the surface contacted by said rollers;

a fluid spray nozzle located within the microwave cavity for spraying fluid on the surface; and at least one microwave generator for directing microwave radiation onto the fluid sprayed on the surface and drying the fluid.

2. A mobile microwave drying apparatus as claimed in claim 1 wherein the front and rear walls of said frame conform generally to the shape of said front and rear rollers with a certain gap, and wherein the thiokness of the tread is less than said gap.

3. A mobile microwave drying apparatus as claimed in claim 1 further including a flexible microwave shield extending from the upper wall into contact with the surface outside of the front, rear and two side walls.

4. A mobile microwave drying apparatus as claimed in claim 3 wherein the flexible microwave shield comprises a heavy fabric material, a coating of microwave absorbent material on the interior of the fabric and wire stays for generally shaping the fabric.

5. A mobile microwave drying apparatus as claimed in claim 1 wherein there are two front rollers, two rear rollers and two treads, each tread extending about respective ones of the front and rear rollers adjacent each side wall.

6. A mobile microwave drying apparatus as claimed in claim 5 wherein the adjacent edges of the two front and two rear rollers form a tongue and groove connection in that a projection from the adjacent edge of one roller extends into a recess in the adjacent edge of the other.

7. A mobile microwave drying apparatus as claimed in claim 1 further includes a vacuum exhaust line connected to the microwave cavity for removing gases formed in the cavity as a result of the drying of the fluid.

8. A mobile microwave drying apparatus as claimed in claim 1 wherein the fluid is paint.

9. A mobile microwave drying apparatus as claimed in claim 8 wherein the apparatus is a trailer for applying highway marking stripes to a pavement and wherein the trailer is pulled by a motor vehicle.

10. A mobile microwave drying apparatus as claimed in claim 8 wherein the apparatus is a wall painting device manually moved about a wall, and the fluid is paint.

11. A mobile microwave drying apparatus as claimed in claim 10 further including a vacuum exhaust line connected to the microwave cavity for removing gases formed in the cavity as a result of the drying of the paint.

12. A mobile microwave drying apparatus as claimed in claim 11 further including a filter for filtering the removed gases and an exhaust for discharging the filtered gases to the atmosphere.

13. A mobile microwave drying apparatus as claimed in claim 1 wherein said rollers are covered with a coating of microwave absorbent material.

14. A mobile microwave highway paint applying and drying apparatus, comprising a generally hollow box-shaped trailer frame with upper, front, rear and two side walls, and an open bottom, the interior surfaces of the frame being covered with a microwave absorbent material and forming a microwave cavity;

front and rear rollers pivotally mounted to the side walls of said frame adjacent the front and rear walls, respectively, such that said trailer is mobile over a highway at a speed of up to 15 miles per hour, the front and rear walls of said frame conforming generally to the shape of said front and rear rollers with a certain gap, the frame being spaced from the surface by a certain distance;

at least one tread extending about said front and rear rollers, said tread being covered with microwave absorbent material, the thickness of said tread being greater than the gap distance so as to substantially eliminate any straight path from the microwave cavity to the exterior of the frame, except through the highway;

a paint spray nozzle located within the microwave cavity for spraying paint markings onto the highway;

at least one microwave generator located within the microwave cavity for directing microwave radiation onto the paint applied to the highway and drying the paint; and a flexible microwave shield in the from of a skirt of flexible material coated on the interior with microwave absorbent material, said skirt extending from the upper wall of said frame into contact with the highway outside of the front, rear and side walls.

* * * * *